United States Patent [19]

Sakuma

[11] 3,940,157

[45] Feb. 24, 1976

[54] SKI STRUCTURE

[75] Inventor: Kenichi Sakuma, Hamamatsu, Japan

[73] Assignee: Nippon Gakki Seizo Kabushiki Kaisha, Hamamatsu, Japan

[22] Filed: Jan. 31, 1974

[21] Appl. No.: 438,463

[30] Foreign Application Priority Data

Feb. 7, 1973 Japan ..... 48-16530[U]
Feb. 28, 1973 Japan ..... 48-25470[U]

[52] U.S. Cl. ..... 280/11.13 L
[51] Int. Cl.[2] ..... A63C 5/00
[58] Field of Search 280/11.13 L, 11.13 M, 11.13 R; 9/310 R, 310 A, 310 D

[56] References Cited

UNITED STATES PATENTS

| | | | |
|---|---|---|---|
| 3,493,240 | 2/1970 | Jenks | 280/11.13 L |
| 3,614,116 | 10/1971 | Haldemann | 280/11.13 L |
| 3,635,484 | 1/1972 | Nakamura et al. | 280/11.13 L |
| 3,652,102 | 3/1972 | Eaton | 280/11.13 L |
| 3,736,609 | 6/1973 | Saucier | 280/11.13 L |
| 3,740,301 | 6/1973 | Manning et al. | 280/11.13 L |

FOREIGN PATENTS OR APPLICATIONS

| | | | |
|---|---|---|---|
| 84,816 | 1965 | France | 280/11.13 L |
| 1,809,011 | 1970 | Germany | 280/11.13 L |
| 1,107,137 | 1961 | Germany | 280/11.13 L |
| 1,453,516 | 1966 | France | 280/11.13 L |

*Primary Examiner*—M. Henson Wood, Jr.
*Assistant Examiner*—David M. Mitchell
*Attorney, Agent, or Firm*—Cushman, Darby & Cushman

[57] ABSTRACT

A ski structure having a core comprising: at least one elastic, tough, box-like inner core frame extending longitudinally within the ski throughout the major portion thereof, upper and bottom members enclosing therein said at least one inner core frame and defining at least one space extending longitudinally for the length of the members, excepting the shovel portion of the ski, and being located adjacent to said inner core frame, filling means contained in said space, and binding means made of a tough plastic material enclosing the inner core frame and the filling means to firmly wrap and bind them together. The filling means in different embodiments of the invention is honeycomb material and foamed plastic.

5 Claims, 7 Drawing Figures

SKI STRUCTURE

BACKGROUND OF THE INVENTION a. Field of the Invention

The present invention pertains to a ski structure, and more particularly, it relates to an improved ski structure having at least one elastic, tough, box-like inner core frame extending longitudinally of the ski for the major length thereof.

b. Description of the Prior Art

It is generally appreciated that recent improvement in skiing techniques and increase in speed which can be achieved is related greatly to the construction of the skis used. As is well known, a ski has core means which, in olden days, was made of wood but for some time the core means has come to be made with plastic materials for the purpose of uniformity in the quality of the materials of skis and also for producing skis having a good balance as a whole. Thus, it has become possible to provide skis of good quality while meeting the demands of modern skiing in general. Moreover, it is known to mold plastic core means to include a hollow region or internal space therein for reducing the physical weight of skis for improving the controllability or operability of skis.

However, hollow skis still present many problems to be solved and characteristics to be improved. Hollow skis, indeed, do have the advantageous features that they are very flexible and easily adapt themselves to changes in the snow surface condition to exert good snow holding. On the other hand, however, they tend to cause skiers a sort of listlessness due to the absence of weight sensed by the feet of the user because of the actual light weight of such skis. Moreover, during movement, such skis cause the user to sense vibrations. Furthermore, though not of primary significance skis of this type lack a luxurious sensation when touched by the fingers of the user.

Additionally, there have been proposed and placed on the market skis whose core means employs honeycomb materials. Skis of this type have various advantageous features such that they have good twistability and are elastic, they can adapt themselves to the changes in the snow surface condition, and they can absorb impacts and vibrations. However, the honeycomb materials used are made of light aluminum alloys which are very expensive to manufacture and this fact can be termed to be the greatest drawback of the skis of this type. Furthermore, currently known skis having only honeycomb material as their filling members give the user a sensation that the skis are of poor substance and are "weak-kneed" skis.

Still further, skis having a markedly enlarged hollow region, and accordingly having a small thickness around this hollow region in order to minimize the total weight of the skis tend to develop sagging of the upper surface of the skis (as shown in FIG. 7) due to the molding pressure received during the manufacture. This causes to develop between the upper surface and the core members. As a result, the bonding relationship between the component members is destroyed, causing warping during use over an extended period of time.

SUMMARY OF THE INVENTION

It is, therefore, a primary object of the present invention to solve the aforesaid various problems of hollow and honeycomb skis while making the most of the advantages of these two types of skis.

Another object of the present invention is to provide hollow skis which are light in weight and yet do not give the user any sensation of listlessness due to their actually being light in weight.

A further object of the present invention is to provide hollow skis of the type described having an improved snow holding ability and having the desirable capabilities to adapt themselves to the changes in the snow surface condition and to absorb impacts and vibrations.

Still another object of the present invention is to provide hollow skis of the type described which, in addition to the foregoing advantageous features, have desirable tough twistability while resisting fatigue of the component materials with which the skis are made.

A still further object of the present invention is to provide hollow skis of the type described, having the aforesaid advantageous features, which can be produced at a relatively low cost.

DETAILED DESCRIPTION OF THE PREFERRED EMBODIMENTS

Description will hereafter be made of preferred embodiments of the present invention by referring to the accompanying drawings. It should be understood that like parts are indicated by like reference symbols and numerals in the various drawings.

Figure 1:
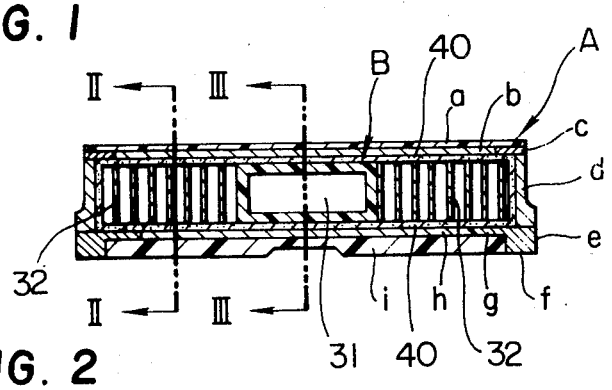
FIG. 1 is a cross sectional view of the central portion of a ski according to one embodiment of the present invention.
Figure 2:
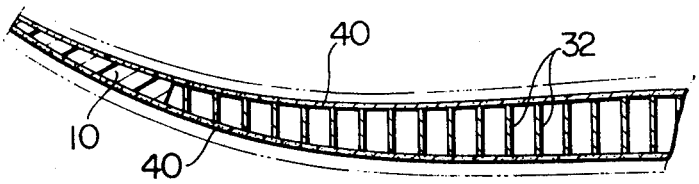
FIG. 2 is a longitudinal cross-sectional view of the forward half of the ski of FIG. 1 taken along the line II—II in FIG. 1 with the upper and bottom surface members being depicted by phantom lines.
Figure 3:
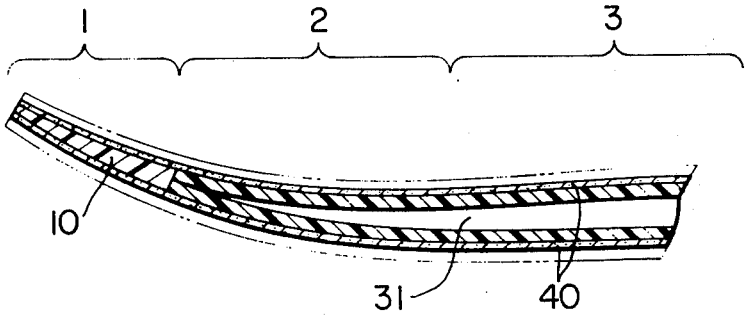
FIG. 3 is a longitudinal cross-sectional view of the forward half of the ski of FIG. 1 taken along the line III—III in FIG. 1 with the upper and bottom surface members being depicted by phantom lines.

In the first example of the present invention shown in FIGS. 1 through 3, description will be made by dividing the illustrated segment of ski A into the following three parts, (see FIG. 3) the forward end portion 1 or shovel portion; the snow surface-contacting portion 2; and the central portion 3. In FIG. 1, A represents in general the ski according to the present invention. Symbol *a* represents a top layer of an appropriate resin. Symbol *b* represents another layer made, for example, of fiber glass. Symbol *c* represents a top edge fastened or glued to the ski. Symbol *d* represents a side of the ski. Symbol *e* represents a bottom edge member. Symbol *f* represents a dependent portion constituting a running surface of the edge member *e*. Symbol *g* represents a lateral web portion. Symbol *h* represents a layer made for example, of fiber glass. Symbol *i* represents a running surface made of an appropriate plastic. These members, i.e. *a*, *b*, *c*, *d*, *e*, *f*, *g*, *h* and *i* which have no immediate relation with the present invention are shown in phantom lines in other Figures of the drawings for the purpose of simplicity. Hereinafter, they will be referred to as the upper and bottom members of the ski.

The forward end portion 1 of the ski includes a core portion 10 made from a plastic material such as acrylonitrile-butadiene-styrene resin and positioned between the upper and bottom members. In the snow surface-contacting portion 2, which is contiguous with the forward end portion 1, the upper and bottom members define a space 31 extending longitudinally of ski and varying in top-to-bottom dimension corresponding to the changes in the top-to-bottom thickness of the ski for the length thereof. The upper and bottom members in the central portion 3 of the ski define an extension of said space 31. The space 31 between the upper and bottom members has a top-to-bottom dimension which is maximum in the vicinity of the central portion of the ski, and it decreases gradually as it approaches the forward end portion. At the snow surface-contacting portion 2, the space 31 terminates. A tough, elastic box-like inner core frame B is provided centrally within the ski A and extends longitudinally of the ski between the upper and bottom members in firmly sandwiched, contiguous relationship therewith. This inner core frame B is made from a fiber-reinforced plastic material such as a glass fiber-reinforced plastic or a carbon fiber-reinforced plastic. In the FIG. 1 example, the box-like inner core frame B has a vacant space therein. The inner core frame B has an outer side wall-to-outer side wall dimension which is about one third, i.e. about 20 mm, of the entire side-to-side dimension, i.e. 60–70 mm, of the ski A. Outwardly of the sides of the inner core frame B and extending in the space 31 for the length of this core frame B and the upper and bottom members, are arranged filling means comprising honeycomb members 32 secured firmly between the upper and bottom members. These honeycomb members 32 which are positioned in the snow surface-contacting portion 2 are smaller in their height in accordance with the varying top-to-bottom dimension of the internal space defined by the upper and bottom members, and those honeycomb members 32 positioned in the central portion 3 are greater in their height in accordance with the varying top-to-bottom dimension of the internal space defined by the upper and bottom members. The respective component members, i.e. core frame B and honeycomb members 32 are enclosed and bound together by a binding member 40 which is made, for example, of a glass fiber-reinforced plastic material so that these members will not become separated from each other. An important feature of this embodiment is to provide an ideal ski by reducing the amount of the expensive honeycomb members employed.

As stated above, the skis according to the foregoing example of the present invention, unlike known hollow skis, while not heavy nevertheless give the user a sensation of a considerable weight and accordingly can remove any sensation of listlessness which the skier may otherwise have while skiing.

Also, the skis just described prevent the development of horizontal as well as vertical vibrations during skiing a drawback of conventional hollow skis, and provide tough twistability and excellent snow holding effect which are peculiar to the honeycomb type skis. Moreover, such skis can adapt themselves to the changes in snow surface condition so as to absorb impacts. Additionally, skis of this kind can be produced at a relatively low cost as compared with known honeycomb type skis. Since the elements forming the centrally located box-like inner core frame and other parts of the ski are constructed from glass fiber-reinformed plastic material or carbon fiber-reinforced plastic material, the skis described above prevent the development of a weakened or fatigued central part even after extended use. Such a weakened part would not hold its initially formed upward curve or arch when loaded with the weight of the user and the arch would become flat and contact the snow surface when carrying the weight of a person. Such weakening of the central part of skis is one of the drawbacks of conventional skis. The aforesaid example of the ski, however, provides sufficient resistance to fatigue of the component parts and the provision of empty inner core frame B provides the user with a spring-like or resilient sensation.

Figure 4:
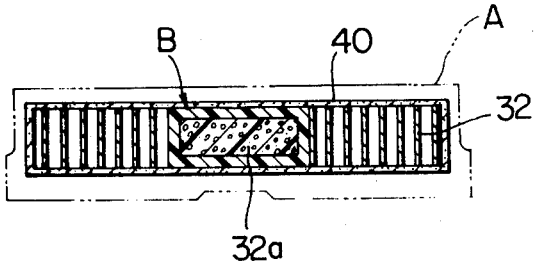
FIG. 4 is a cross-sectional view similar to FIG. 1, but showing a ski wherein the inner core frame contains therein a foamed plastic.

FIG. 4 is a modified version of FIG. 1. In this embodiment, the empty box-like core frame B of FIG. 1 is stuffed with a foamed plastic 32*a* such as foamed urethane. As a result, the ski as a whole provides the user with what may be called a "ponderous" or "substantial" sensation as it reduces the feeling of light ski, albeit that the ski actually is not heavy. The user can gets the sensation of stability from such a ski.

Descriptions have been made of examples wherein the skis have only one inner core frame. Though not shown in the drawings, those skilled in the art will easily understand that the skis may have more than one core frame.

The descriptions hereinafter are of further modified examples of the present invention.

Figure 5:
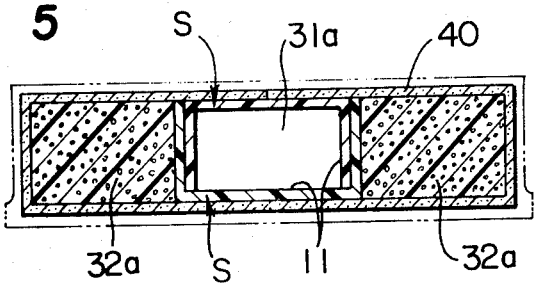
FIG. 5 is a cross-sectional view of the central portion of a ski according to a further embodiment of the present invention, with the upper and the bottom surface members and side members being depicted by phantom lines.

In FIG. 5 is shown an embodiment in which the box-like inner core frame, generally indicated at S, comprises two U-shaped inner core frame elements 11 which are assembled together so that one of these elements is received within the other to define a space 31*a* of a substantially rectangular cross section. These assembled U-shaped elements 11 are made of the same fiber-reinforced plastics as in the preceding examples, and they are disposed in the central portion of the ski along the length of the upper and bottom members. The inner core frame S is flanked on both sides by filling means 32*a* which are made from a foamed plastic, such as urethane. The inner core frame S, as well as the filling means 32*a* are surrounded and hold together firmly by a binding members 40 to provide an entire core. The ends of the binding member 40 are arranged flush with one another to avoid the formation of a region longitudinally of the ski, which bulging region would be produced if the end portions of the binding member 40 were arranged to overlap one another.

Figure 6:
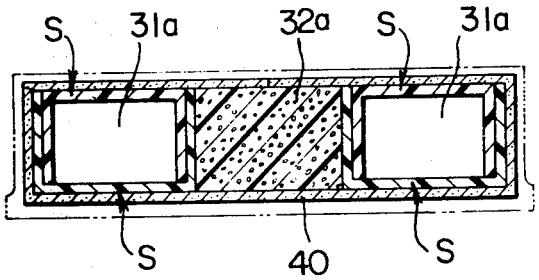
FIG. 6 is a cross-sectional view, similar to that of FIG. 5, of still another embodiment of the present invention, with the upper and the bottom surface members and side members being shown in phantom lines.
Figure 7:
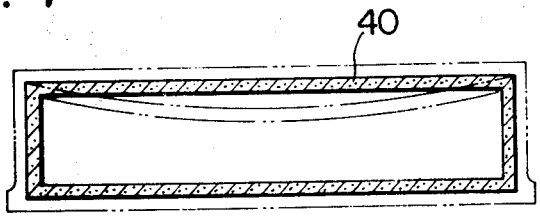
FIG. 7 is a diagrammatic cross-sectional view, depicting the sagging of the upper surface which tends to develop in conventional hollow skis.

FIG. 6 shows a still further embodiment of the present invention in which the filling means 32*a* disposed in the central part of the ski, longitudinally thereof, is flanked on both sides by two box-like inner core frames S, S each being formed in the same manner as described in the preceding example and shown in FIG. 5.

By so constructing the core means as in the examples of FIGS. 5 and 6, the weight of the ski is reduced while the sensation of light weight is reduced by the provision of the filling member. As stated previously, instead of the filling means being made of honeycomb, as in the examples illustrated in FIGS. 1–4 the filling means of the embodiments of FIGS. 5 and 6 is made from a foamed resin. Therefore, an ideal ski is provided while reducing its weight and yet imparting a sensation of weight and stability to the user of this ski.

I claim:

1. A ski structure comprising separate upper and bottom members defining a space therebetween which extends substantially the length of said ski; a single elastic, box-like inner core frame located within said space and extending longitudinally of the ski, said frame being dimensioned in width to occupy only a portion of said space; filling means on opposite sides of said core frame occupying substantially the remaining portion of said space laterally of the frame; and binding means within said space surrounding the frame and the filling means to hold same together as a unit.

2. A ski structure according to claim 1, wherein said frame has a hollow interior which contains a foamed plastic.

3. A ski structure according to claim 2, wherein said filling means comprises honeycomb members.

4. A ski structure comprising separate upper and bottom members defining a space therebetween which extends substantially the length of said ski; a single elastic, box-like inner core frame located within said space and extending longitudinally of the ski, said frame being dimensioned in width to occupy only a portion of said space; filling means comprising honeycomb members on opposite sides of said core frame occupying substantially the remaining portion of said space laterally of the frame; and binding means within said space surrounding the frame and the filling means to hold same together as a unit.

5. A ski structure according to claim 4, wherein said frame has a hollow interior which contains a foamed plastic.

* * * * *